US008607506B2

(12) United States Patent
Bouthillier

(10) Patent No.: US 8,607,506 B2
(45) Date of Patent: Dec. 17, 2013

(54) GLASS HANDLE CONNECTOR FOR GLASS DOOR HANDLE

(75) Inventor: Serge Bouthillier, Sainte-Marthe-sur-le-Lac (CA)

(73) Assignee: Groupe VFG Inc., Boise-des-Filion, Quebec (CA)

( * ) Notice: Subject to any disclaimer, the term of this patent is extended or adjusted under 35 U.S.C. 154(b) by 42 days.

(21) Appl. No.: 13/112,261

(22) Filed: May 20, 2011

(65) Prior Publication Data

US 2012/0240472 A1 Sep. 27, 2012

(30) Foreign Application Priority Data

Mar. 24, 2011 (CA) ..... 2734667

(51) Int. Cl.
*E05B 1/00* (2006.01)

(52) U.S. Cl.
USPC ..... 49/460; 16/412

(58) Field of Classification Search
USPC ..... 49/460; 16/412
See application file for complete search history.

(56) References Cited

U.S. PATENT DOCUMENTS

| | | | | |
|---|---|---|---|---|
| 1,341,969 | A | 6/1920 | Breul | |
| 2,601,596 | A | 6/1952 | Cronin | |
| 4,499,629 | A * | 2/1985 | Grossman | 16/413 |
| 4,862,642 | A * | 9/1989 | Alessi | 49/460 |
| 6,250,044 | B1 * | 6/2001 | Funk et al. | 52/782.1 |
| 6,463,628 | B1 * | 10/2002 | Yeh | 16/412 |
| 6,543,089 | B2 * | 4/2003 | Tasman | 16/412 |
| 6,966,101 | B2 * | 11/2005 | Chiang | 16/412 |
| 7,219,394 | B2 * | 5/2007 | Wu | 16/412 |
| 8,201,307 | B2 * | 6/2012 | Romero | 16/412 |
| 2005/0060844 | A1 * | 3/2005 | Chiang | 16/412 |
| 2010/0199569 | A1 * | 8/2010 | Piedade | 49/460 |

FOREIGN PATENT DOCUMENTS

WO 03/090004 A1 10/2003

* cited by examiner

*Primary Examiner* — Jerry Redman
(74) *Attorney, Agent, or Firm* — K&L Gates LLP

(57) ABSTRACT

A door handle and door-handle connector assembly comprises a door handle having a glass body and at least one door-handle connector. The door-handle connector comprises a glass interface having an elongated body made of glass. The body has a first end adhered to the glass body of the door handle, and a second end having a head portion. The door-handle connector also comprises a door interface having an inner cavity receiving the head portion of the glass interface, and an opening for the elongated body of the glass interface to project out of the door interface to be connected to the door handle. The door interface is adapted to be secured to a door whereby the glass interface is held captive to the door interface by the head portion held by the door interface. A door system and a door-handle connector are also provided.

26 Claims, 3 Drawing Sheets

GLASS HANDLE CONNECTOR FOR GLASS DOOR HANDLE

CROSS-REFERENCE TO RELATED APPLICATION

The present patent application claims priority on Canadian Patent Application Serial No. 2,734,667, filed on Mar. 24, 2011, and incorporated herein by reference.

FIELD OF THE INVENTION

The present disclosure pertains to glass door components such as a glass door handle and a glass door into a connector interfacing a glass door handle to a door.

BACKGROUND OF THE ART

Glass is an increasingly popular material, used in post-modern and contemporary architecture and design, among other trends. Conditioning and treatment techniques have evolved so as to change the properties of glass and render it structurally strong. Accordingly, there are numerous structural applications for glass components. For instance, curtain walls are commonly used for the outer shell of buildings. Glass doors, glass door handles, and glass partitions are also commonly found, for instance in industrial applications. Moreover, in domestic applications, glass is commonly used in washrooms, in kitchens, etc. However, there are restrictions to using glass for all structural components, namely related to interfacing glass to other components.

SUMMARY OF THE APPLICATION

Therefore, it is an aim of the present disclosure to provide a door-handle connector having an interface made of glass, for glass door handles.

It is a further aim of the present disclosure to provide an assembly of a door, a glass door handle, and a glass door-handle connector interfacing the glass door handle to the door.

Therefore, in accordance with the present disclosure, there is provided a door handle and door-handle connector assembly comprising: a door handle having a glass body; and at least one door-handle connector comprising: a glass interface having an elongated body made of glass and having a first end adhered to the glass body of the door handle, and a second end having a head portion; and a door interface having an inner cavity receiving the head portion of the glass interface, and an opening for the elongated body of the glass interface to project out of the door interface to be connected to the door handle, the door interface adapted to be secured to a door whereby the glass interface is held captive to the door interface by the head portion held by the door interface.

Further in accordance with the present application, there is provided a door system comprising: a door; door handle having a glass body; and at least one door-handle connector connecting the door handle to the door, the door-handle connector comprising: a glass interface having an elongated body made of glass and having a first end adhered to the glass body of the door handle, and a second end having a head portion; and a door interface having an inner cavity receiving the head portion of the glass interface, and an opening for the elongated body of the glass interface to project out of the door interface to be connected to the door handle, the door interface being secured to the door whereby the glass interface is held captive to the door interface by the head portion held by the door interface.

Further in accordance with the present application, there is provided a door-handle connector comprising: a glass interface having an elongated body made of glass and having a first end adapted to be adhered to the glass body of the door handle, and a second end having a head portion; and a door interface having an inner cavity receiving the head portion of the glass interface, and an opening for the elongated body of the glass interface to project out of the door interface to be connected to the door handle, the door interface adapted to be secured to a door whereby the glass interface is held captive to the door interface by the head portion held by the door interface.

DESCRIPTION OF THE PREFERRED EMBODIMENTS

Figure 1:
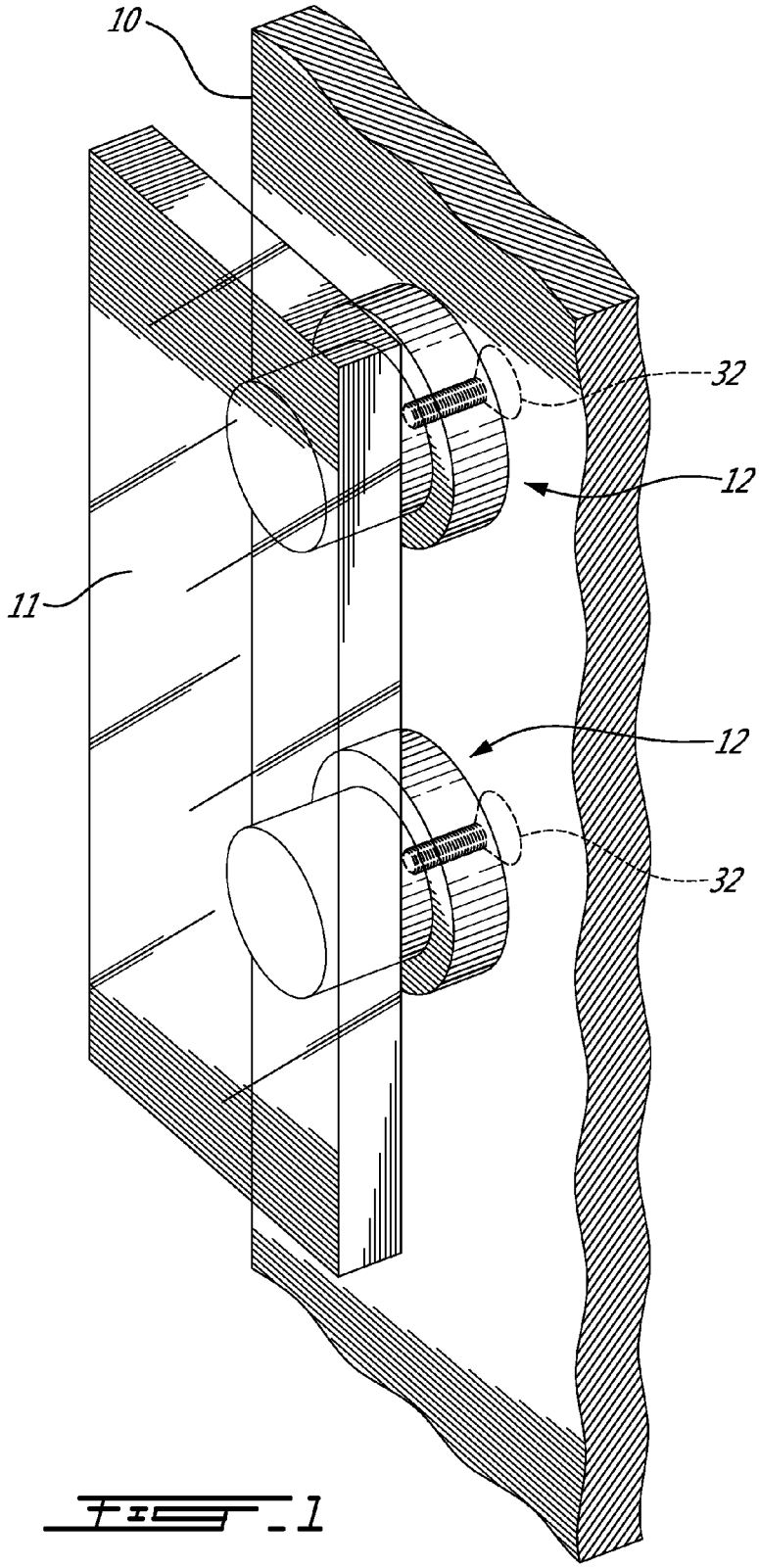
FIG. 1 is a perspective view of a pair of glass door-handle connectors interfacing a glass door handle to a door in accordance with an embodiment of the present disclosure.

Referring to the drawings and more particularly to FIG. 1, there is illustrated a door 10. The door 10 may be of any material. However, the door 10 is equipped with a glass door handle 11 and glass door-handle connectors 12, whereby the door 10 may appropriately be made of glass as well, in accordance with the transparency of these components. Some of the elements described hereinafter are referred to as being made of glass. It is understood that the glass used for door applications is treated to have structural properties, and may be painted, stained, etched, etc. However, for simplicity purposes, reference is hereinafter made to glass.

The glass door handle 11 is made of glass and is shown having a rectangular shape. However, any appropriate shape may be used for the glass door handle 11.

In FIG. 1, there is illustrated a pair of the glass door-handle connectors 12. However, a glass door handle such as the one illustrated at 11 in FIG. 1 may be connected to the door 10 by a single one of the glass door-handle connectors 12 or more than two. If a single one of the glass door-handle connectors 12 is used, all necessary precautions must be taken such that the glass door-handle connector 12 may support the glass door handle 11.

Figure 2:
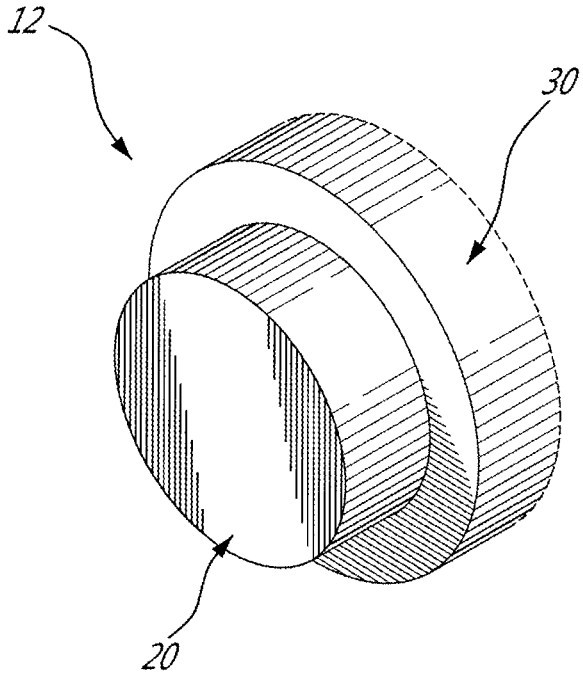
FIG. 2 is a perspective view of one of the glass door-handle connectors of FIG. 1.
Figure 3:
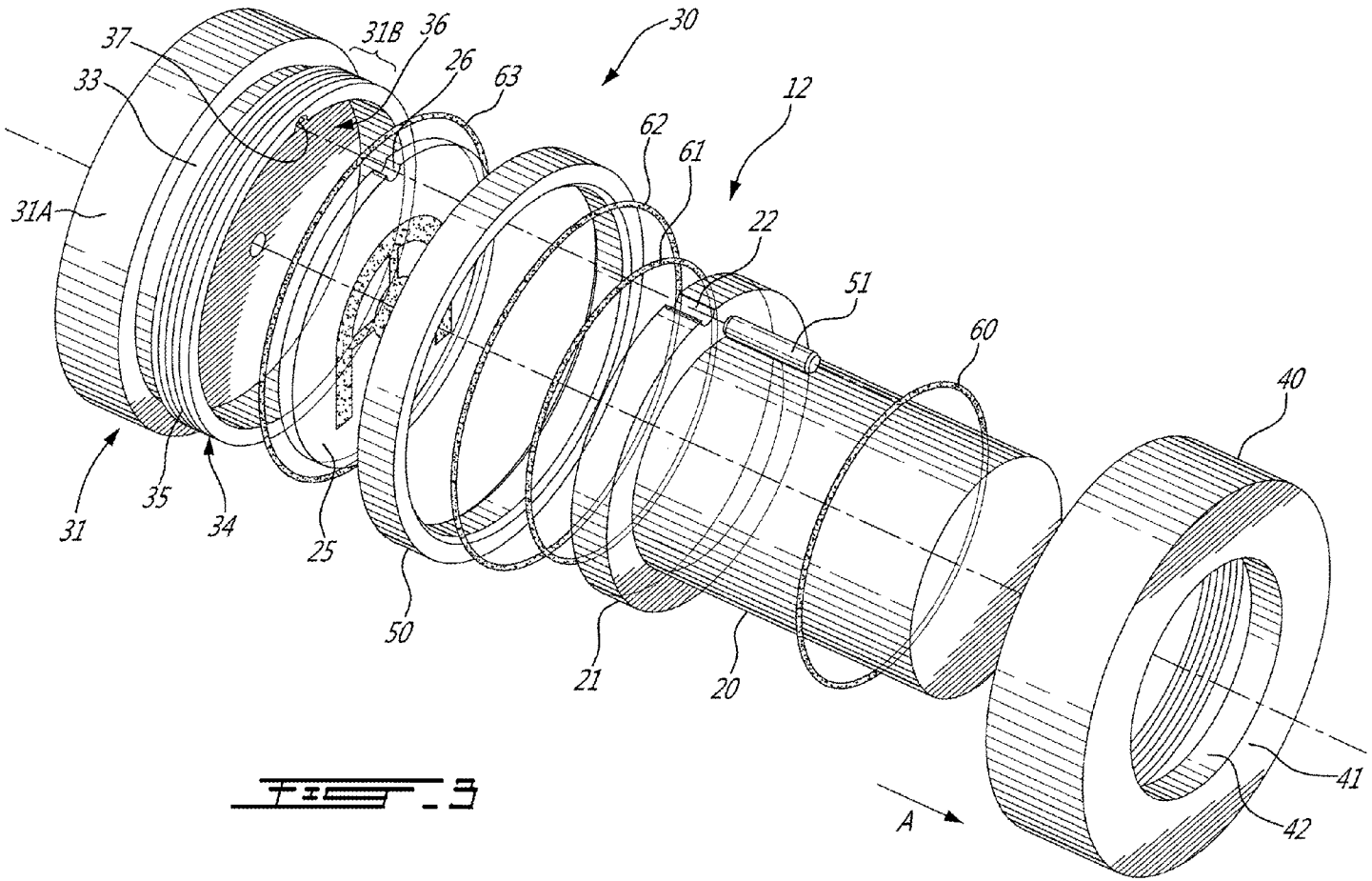
FIG. 3 is an assembly view of a glass door-handle connector of FIG. 2, in accordance with an embodiment.

Referring to FIGS. 2 and 3, the glass door-handle connector 12, hereinafter the connector 12, has a glass interface 20. The glass interface 20 is typically an elongated piece of glass (cylindrical) having substantially flat surfaces at opposed ends. Accordingly, the glass interface 20 may be bonded to the glass door handle 11 using appropriate adhesives. According to an embodiment, adhesives using UV curing are used, which adhesives have clear and colorless properties. As another alternative, triolyse adhesive is used to secure the glass interface 20 to the glass door handle 11.

Similarly, a glass head disk 21 is adhered to the opposite end of the elongated body to define the glass interface 20. Similar adhesion techniques and adhesives are used therefor. The glass head disk 21 has a greater diameter than the glass interface 20, thereby defined the head shape. The head disk 21 may be any head portion of any shape, but extending beyond the diameter of the elongated body of the glass interface 20 (e.g., on a portion of the diameter). The glass head disk 21 may have a groove 22 in its radial surface for the subsequent alignment of the glass interface 20 with the glass door handle 11 and door 10. It is observed that a portion of the glass interface 20 has a cylindrical elongated shape. However, any portion of the glass interface 20 may have any other appropriate cross-sectional shape other than the circular cross-sections of FIGS. 1 to 3.

Referring to FIG. 3, a decorative disk 25 may be provided and will be laid against a free surface of the glass head disk 21. Therefore, considering that the glass interface 20 and the glass head disk 21 may be transparent or translucent, any logo or design on the decorative disk 25 may be visible through the glass interface 20 and therefore through the glass door handle 11. The decorative disk 25 may be a glass disk or any other substrate supporting an image, such as paper, cardboard or plastic substrate. Moreover, a decorative design may be applied directly to the free surface of the glass head disk 21. For instance, a decorative design may be etched, drawn, painted, etc on the glass head disk 21. It is observed that the decorative disk may have a cut-out 26 for the alignment as will be described hereinafter.

Referring to FIGS. 2 and 3, the glass door-handle connector 12 also features a door interface 30. The door interface 30 is used to connect the glass door-handle connector 12 to the door 10. The door interface 30 has a base 31. The base 31 has a disk portion 31A that will abut against the surface of the door 10, and a sleeve portion 31B projecting from the disk portion 31A. As shown in FIG. 1, fasteners such as bolts 32 may be used to connect the base to the door. Accordingly, the base 31 in such a configuration has a tapped bore for being screwingly engaged by the bolt 32. Any other appropriate connection means could be used for the base 31 to be connected to the door 10. The bolts 32 may also be used to connect other a handle to an opposite side of the door, in any appropriate way.

Referring to FIG. 3, the sleeve portion 31B of the base 31 has a neck 33 and a head 34. The head 34 has a radial surface 35 that is threaded. The neck 33 and head 34 define concurrently an inner cavity 36 of the base 31. A diameter of the inner cavity 36 is slightly larger than the diameter of the glass head disk 21, as the glass head disk 21 will be accommodated in the inner cavity 36 of the base 31 when the glass door-handle connector 12 is assembled as shown in FIG. 2. Moreover, a groove 37 is provided in a radial surface of the inner cavity 36 for alignment of the various components of the glass door-handle connector 12.

A cap 40 may also be part of the door interface 30 and is connected to the base 31. The cap 40 is a tubular component. In an embodiment, the cap 40 is tapped so as to be screwed to the threading of the radial surface 35 of the base 31. An annular wall 41 projects inwardly from an end of the cap 40 so as to define an opening 42. The diameter of the opening 42 is smaller than an inner diameter of a remainder of the cap 40. The diameter of the opening 42 is slightly larger or equal to the diameter of the glass interface 20. Accordingly, the assembly of the glass interface 20 and glass head disk 21, as integrally adhered to one another, is held captive from moving out of the cap 40 in the longitudinal direction illustrated as A in FIG. 3. Therefore, the glass interface 20 and glass head disk 21 are held captive in the door interface 30 by the cooperation of the cap 40 and the base 31.

Still referring to FIG. 3, depending on the thickness of the glass head disk 21 and, if applicable, of the decorative disk 25, a spacer 50 may be provided. The spacer 50 is a ring that moves onto the neck 33 of the base 31. According to an embodiment, the spacer 50 is simply fitted over the neck 30 without being threaded thereto. The cap 40 is then screwed onto the head 34 of the door interface 30, whereby the spacer 50 is held captive between the cap 40 and the base 31.

Spacers 50 of different heights may be provided for standard base 31 and cap 40 diameters, to adapt the door interface 30 to different thicknesses of head disk 21.

A pin 51 may be used for the alignment of the glass head disk 21 and of the decorative disk 25 with the door interface 30. Accordingly, when the door interface 30 is mounted to the door 10, necessary care is taken so as to ensure that the groove 37 is in a alignment orientation, for instance at an uppermost orientation. When positioning the decorative disk 25 and the glass head disk 21 inside the inner cavity 36 of the door interface 30, the cut-out 26 and the groove 22 of the decorative disk 25 and of the glass head disk 21 respectively are aligned for the pin 51 to be threaded therethrough.

The door 10 may be an exterior door whereby some components may be required to ensure that water does not infiltrate the glass door-handle connector 12. Accordingly, various sealing joints may be used at the junction between some of the above-referred components. For instance, sealing joint 60 is inserted in the cap 40 and will be located between the cap 40 and the glass head disk 21. Sealing joint 61 will be between a door-side surface of the glass head disk 21 and an inner surface of the inner cavity 36 of the base 31. Sealing joint 62 will be between the cap and the spacer 50. Finally, sealing joint 63 will be between the spacer 50 and the base 31. other types of arrangements are considered as well. The various sealing joints may typically be some o-rings or any other type of appropriate joints. However, any other type of shape may be used as well.

It is observed that the glass interface 20 and/or the door interface 30 have circular cross-sections, but may have any other suitable shape. While the components of the glass interface 20 are typically made of glass, the door interface 30 is made from metal or like structural material, such as stone, concrete, etc.

The invention claimed is:

1. A door handle assembly comprising:

a door handle having a glass body; and at least one door-handle connector comprising:

a glass interface having an elongated body made of glass and having a first end adhered to the glass body of the door handle, and a second end having a head portion, the head portion being a glass disk adhered to an elongated cylinder to define the glass interface; and a door interface having an inner cavity receiving the head portion of the glass interface, and an opening for the elongated body of the glass interface to project out of the door interface to be connected to the door handle, the door interface adapted to be secured to a door whereby the glass interface is held captive to the door interface by the head portion held by the door interface.

2. The door handle assembly according to claim 1, wherein the glass disk and the elongated cylinder each have a generally circular cross-section.

3. The door handle assembly according to claim 1, further comprising an image on one of a substrate laid against an end surface of the head portion, and of the end surface of the head portion.

4. The door handle assembly according to claim 1, further comprising a sealing joint between a surface of the head portion and a surface of the inner cavity.

5. The door handle assembly according to claim 1, further comprising an alignment pin, and grooves in the head portion and in the door interface for setting an orientation of the glass interface relative to the door interface.

6. The door handle assembly according to claim 1, wherein the door interface comprises a base adapted to be secured to the door, and a tubular cap releasably secured to the base, with said opening being in the cap.

7. The door handle assembly according to claim 6, further comprising a sealing joint between the head portion and the tubular cap about the elongated body.

8. The door handle assembly according to claim 6, wherein the base has a disk portion and a sleeve portion projecting from the disk portion for attachment of the tubular cap thereto, with the disk portion and the tubular cap concurrently defining said inner cavity receiving the head portion.

9. The door handle assembly according to claim 8, further comprising a sealing joint about the sleeve portion between the disk portion and the tubular cap.

10. The door handle assembly according to claim 8, further comprising a spacer about the sleeve portion and between the disk portion and the tubular cap to increase a dimension of the inner cavity.

11. The door handle assembly according to claim 10, further comprising a sealing joint about the sleeve portion between the disk portion and the spacer.

12. The door handle assembly according to claim 10, further comprising a sealing joint between the spacer and the cap about the elongated body.

13. The door handle assembly according to claim 6, wherein the cap has tapping, and the base has radial threading, the cap being screwed onto the base.

14. The door handle assembly according to claim 6, wherein the base and the tubular cap are made of a metallic material.

15. The door handle assembly according to claim 6, wherein the base comprises a tapped bore adapted to being screwingly engaged to a fastener of the door.

16. The door handle assembly according to claim 6, further comprising a sealing joint between the head portion and the tubular cap about the elongated body.

17. The door handle assembly according to claim 6, wherein the base has a disk portion and a sleeve portion projecting from the disk portion for attachment of the tubular cap thereto, with the disk portion and the tubular cap concurrently defining said inner cavity receiving the head portion.

18. The door handle assembly according to claim 17, further comprising a sealing joint about the sleeve portion between the disk portion and the tubular cap.

19. The door handle assembly according to claim 17, further comprising a spacer about the sleeve portion and between the disk portion and the tubular cap to increase a dimension of the inner cavity.

20. The door handle assembly according to claim 19, further comprising a sealing joint about the sleeve portion between the disk portion and the spacer.

21. The door handle assembly according to claim 19, further comprising a sealing joint between the spacer and the cap about the elongated body.

22. A door-handle connector comprising:

a glass interface having an elongated body made of glass and having a first end adapted to be adhered to the glass body of the door handle, and a second end having a head portion, the head portion being a glass disk adhered to an elongated cylinder to define the glass interface; and a door interface having an inner cavity receiving the head portion of the glass interface, and an opening for the elongated body of the glass interface to project out of the door interface to be connected to the door handle, the door interface adapted to be secured to a door whereby the glass interface is held captive to the door interface by the head portion held by the door interface.

23. A door handle assembly comprising:

a door handle having a glass body; and at least one door-handle connector comprising:

a glass interface having an elongated body made of glass and having a first end adhered to the glass body of the door handle, and a second end having a head portion; and a door interface having an inner cavity receiving the head portion of the glass interface, and an opening for the elongated body of the glass interface to project out of the door interface to be connected to the door handle, the door interface comprising a base adapted to be secured to a door whereby the glass interface is held captive to the door interface by the head portion held by the door interface, and a tubular cap releasably secured to the base, with said opening being in the cap.

24. The door handle assembly according to claim 23, wherein the cap has tapping, and the base has radial threading, the cap being screwed onto the base.

25. The door handle assembly according to claim 23, wherein the base and the tubular cap are made of a metallic material.

26. The door handle assembly according to claim 23, wherein the base comprises a tapped bore adapted to being screwingly engaged to a fastener of the door.

* * * * *